US009594324B2

(12) United States Patent
Tamagaki et al.

(10) Patent No.: US 9,594,324 B2
(45) **Date of Patent: *Mar. 14, 2017**

(54) ELECTROSTATIC LATENT IMAGE DEVELOPING TONER

(71) Applicant: KYOCERA Document Solutions Inc., Osaka (JP)

(72) Inventors: Masashi Tamagaki, Osaka (JP); Tomoyuki Ogawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/984,486

(22) Filed: Dec. 30, 2015

(65) Prior Publication Data

US 2016/0202623 A1 Jul. 14, 2016

(30) Foreign Application Priority Data

Jan. 9, 2015 (JP) ..... 2015-003389

(51) Int. Cl.
*G03G 9/093* (2006.01)
*G03G 9/08* (2006.01)
*G03G 9/097* (2006.01)

(52) U.S. Cl.
CPC ..... *G03G 9/09314* (2013.01); *G03G 9/0821* (2013.01); *G03G 9/09725* (2013.01)

(58) Field of Classification Search
CPC ..... G03G 9/09314; G03G 9/09725
See application file for complete search history.

(56) References Cited

U.S. PATENT DOCUMENTS

2014/0141370 A1* 5/2014 Sasaki ..... G03G 9/09725 430/111.4
2014/0147785 A1* 5/2014 Matsushita ..... G03G 15/08 430/124.1

FOREIGN PATENT DOCUMENTS

JP 2007-171272 A 7/2007

* cited by examiner

*Primary Examiner* — Hoa V Le
(74) *Attorney, Agent, or Firm* — Studebaker & Brackett PC

(57) ABSTRACT

An electrostatic latent image developing toner contains a plurality of toner particles. The toner particles each include a toner mother particle and an external additive. The toner mother particle includes a toner core and a shell layer disposed over a surface of the toner core. The shell layer contains a thermosetting resin and a thermoplastic resin. The toner mother particles have a surface roughness of no less than 10 nm and no greater than 15 nm. The toner mother particles have a surface adsorbability of no less than 10 nN and no greater than 20 nN.

4 Claims, 1 Drawing Sheet

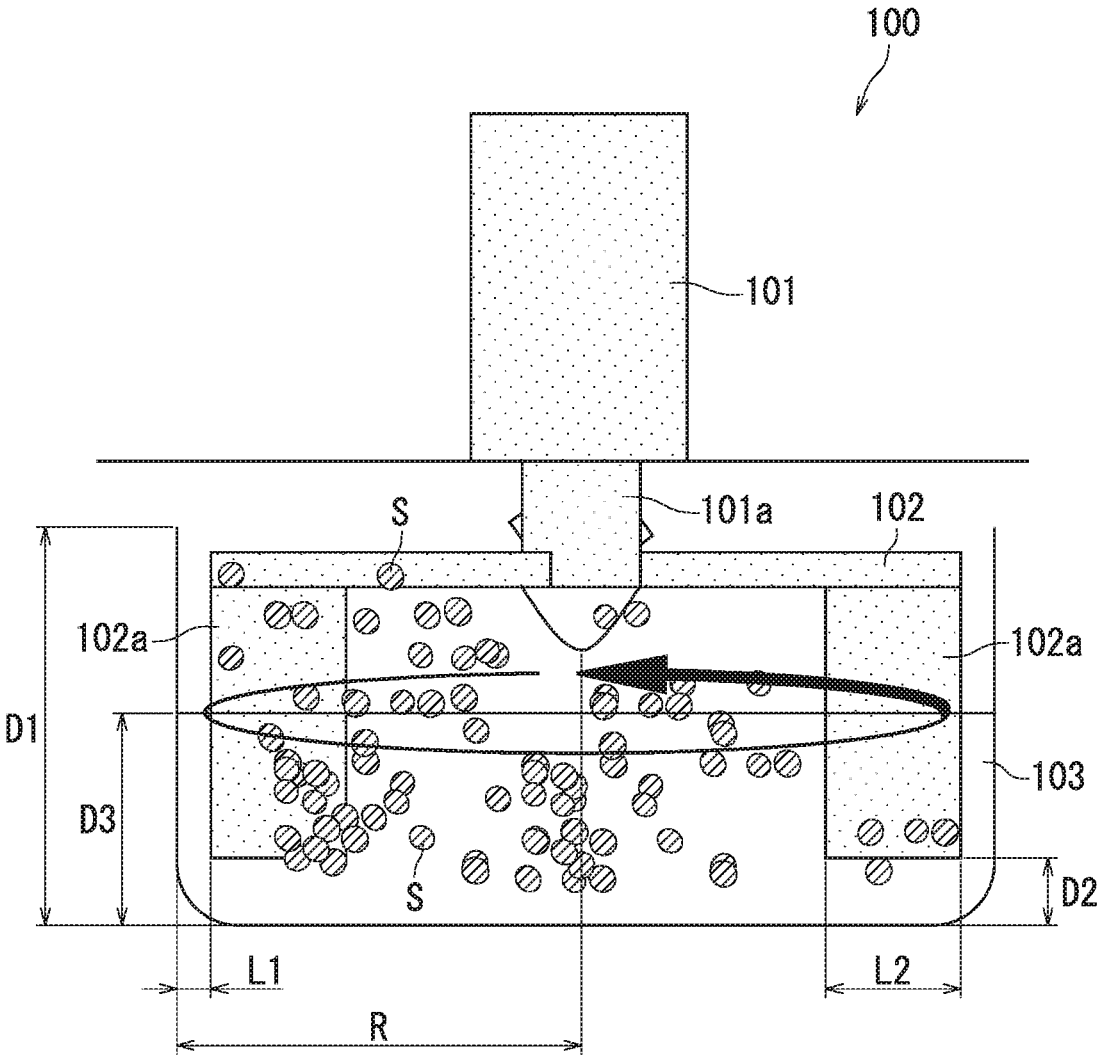
100
101
101a
102
S
102a
102a
D1
D3
103
S
D2
L1
L2
R

ELECTROSTATIC LATENT IMAGE DEVELOPING TONER

INCORPORATION BY REFERENCE

The present application claims priority under 35 U.S.C. §119 to Japanese Patent Application No. 2015-003389, filed on Jan. 9, 2015. The contents of this application are incorporated herein by reference in their entirety.

BACKGROUND

The present disclosure relates to an electrostatic latent image developing toner (hereinafter, may be referred to as a toner).

Toner particles contained in a capsule toner each have a toner core and a shell layer (capsule layer) disposed over a surface of the toner core. One example of a method that has been considered for improving low-temperature fixability and preservability of a toner is by specifying the average volume diameter and the average roundness of pigmented resin particles, and the average fracture strength of the toner.

SUMMARY

A toner according to the present disclosure contains a plurality of toner particles. The toner particles each include a toner mother particle and an external additive. The toner mother particle includes a toner core and a shell layer disposed over a surface of the toner core. The shell layer contains a thermosetting resin and a thermoplastic resin. The toner mother particles have a surface roughness of no less than 10 nm and no greater than 15 nm. The toner mother particles have a surface adsorbability of no less than 10 nN and no greater than 20 nN.

BRIEF DESCRIPTION OF THE DRAWINGS

FIGURE is a diagram illustrating a deterioration device for causing deterioration of a developer.

DETAILED DESCRIPTION

Hereinafter, an embodiment of the present disclosure will be described. The term "(meth)acrylic" may be used herein as a generic term for both acrylic and methacrylic. The term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof.

An average value used herein refers to an arithmetic mean value unless otherwise stated. When evaluation values (for example, values indicating shapes or properties) pertaining to powders (for example, toner, toner particles, toner mother particles, toner cores, and external additives to be described later) are given, such evaluation values are also arithmetic mean values (number average values) unless otherwise stated. An arithmetic mean value is obtained by adding up values measured with respect to an appropriate number of measurement targets and dividing the sum by the number. The particle diameter of a powder is the diameter of a representative circle of a primary particle measured using an electron microscope unless otherwise stated. The diameter of a representative circle is the diameter of a circle having the same area as a projection of the particle.

The present embodiment relates to a toner. The toner according to the present embodiment may be used for development of an electrostatic latent image. The toner according to the present embodiment is a powder of a large number of particles (hereinafter, referred to as toner particles). The toner according to the present embodiment contains a plurality of (a large number of) toner particles. The toner according to the present embodiment can for example be used in an electrophotographic apparatus (image forming apparatus).

Hereinafter, an example of an image forming method performed by the electrophotographic apparatus will be described. First, an electrostatic latent image is formed on a photosensitive member based on image data. Next, the electrostatic latent image that is formed is developed using a two-component developer containing a carrier and a toner. In a developing step, charged toner is caused to adhere to the electrostatic latent image. After the adhered toner has been transferred onto a transfer belt as a toner image, the toner image on the transfer belt is transferred onto a recording medium (for example, paper). Next, the toner is fixed to the recording medium by heating the toner. Through the above process, an image is formed on the recording medium. A full-color image can for example be formed by superimposing toner images of four different colors: black, yellow, magenta, and cyan.

Toner particles contained in the toner according to the present embodiment each have a toner core and a shell layer (capsule layer) disposed over a surface of the toner core. The shell layer is disposed over the surface of the toner core so as to cover the toner core. An external additive adheres to a surface of the shell layer. More than one shell layer may be layered on the surface of the toner core. The term "toner mother particles" used herein refers to toner particles prior to adhesion of an external additive.

The toner according to the present embodiment satisfies the following conditions (1) to (3).

(1) The shell layers contain a thermosetting resin and a thermoplastic resin.

(2) The toner mother particles have a surface roughness of no less than 10 nm and no greater than 15 nm.

(3) The toner mother particles have a surface adsorbability of no less than 10 nN and no greater than 20 nN.

The condition (1) is effective for improving both high-temperature preservability and fixability of the toner. More specifically, the thermoplastic resin is expected to contribute to the improvement in the fixability (in particular, low-temperature fixability) of the toner, and the thermosetting resin is expected to contribute to the improvement in the high-temperature preservability of the toner.

A toner satisfying the conditions (2) and (3) can maintain sufficient charge. Use of a toner satisfying the conditions (2) and (3) enables restriction of fogging and formation of high-quality images. The following provides detailed explanation. The external additive that has become detached (desorbed) from the toner mother particles is likely to cause an image defect (for example, fogging) or reduced chargeability. As a result of the toner mother particles having a surface roughness of no less than 10 nm and no greater than 15 nm and having a surface adsorbability of no less than 10 nN and no greater than 20 nN, the toner particles easily maintain a desorption of the external additive within a certain range. It is thought that as a result, fluidity of the toner particles is improved, restricting occurrence of an image defect (for example, fogging) and reduced chargeability.

In order to restrict occurrence of so-called replenishment fogging, the toner mother particles preferably have a surface adsorbability of no less than 15 nN and no greater than 20 nN, and more preferably no less than 18 nN and no greater than 20 nN. The replenishment fogging refers to an image defect that occurs when a developer in a developing device contains deteriorated toner and is replenished with new toner that is not deteriorated, and the toner having reduced charge (deteriorated toner) is attracted to a non-exposed section (non-image section) of a photosensitive member due to a charge difference between the deteriorated toner and the new toner.

The surface roughness of the toner mother particles can for example be measured using a scanning probe microscope and a cantilever. More specifically, an image of 256×256 pixels is obtained by measuring a surface profile of a measurement target (toner mother particle) using a scanning probe microscope and a cantilever under conditions of an observation area of 1 μm×1 μm, a scanning frequency of 1 Hz, a magnification for plotting a Q-curve of ×1.001, and an amplitude extinction ratio of −0.4. Roughness analysis is performed on the image thus obtained to determine the surface roughness (ten-point average roughness) of the measurement target (toner mother particle). Values of the surface roughness (ten-point average roughness) of five to ten measurement targets are determined, and a number average value thereof is taken as a surface roughness of the toner mother particles.

The surface adsorbability of the toner mother particles can for example be measured using a scanning probe microscope and a cantilever. More specifically, a projection of a toner mother particle is placed at the center of a measurement area. The scanning probe microscope and the cantilever are set at a measurement range of −10 nm to 100 nm and at a magnification of ×1.00. Next, sweeping is performed around a peak of the projection determined in the measurement range for 5 seconds to plot a force curve. Thus, the surface adsorbability of the toner mother particle can be measured.

The surface roughness of the toner mother particles and the surface adsorbability of the toner mother particles can be measured even if the toner mother particles already have an external additive adhering to the surface thereof (even after external addition). For example, the surface roughness and the surface adsorbability of a toner mother particle after external addition are measured by positioning the probe of the scanning probe microscope at a region of the toner mother particle that does not have the external additive. For another example, the surface roughness and the surface adsorbability of a toner mother particle after external addition are measured by removing the external additive from the toner mother particle.

The toner according to the present embodiment preferably satisfies the following condition (4).

(4) The toner particles have a desorption of the external additive of no less than 5% and no greater than 10%.

The desorption of the external additive being no less than 5% facilitates restriction of occurrence of reduced charge of the toner. The desorption of the external additive of no less than 5% also facilitates restriction of occurrence of fogging in resulting images even in the case of repeated image formation. The desorption of the external additive being no greater than 10% facilitates restriction of occurrence of replenishment fogging in resulting images. More preferably, the desorption of the external additive is no less than 5% and no greater than 8% in order to restrict occurrence of replenishment fogging more effectively.

The desorption of the external additive is for example represented by expression (1). In the expression (1), R represents a desorption of the external additive (more specifically, a percentage of the external additive desorbed from the toner mother particles). $IN_B$ represents a fluorescent X-ray intensity of an external additive element obtained through measurement of the toner particles prior to external additive desorbing using an X-ray fluorescence spectrometer. $IN_A$ represents a fluorescent X-ray intensity of the external additive element obtained through measurement of the toner particles after the external additive desorbing using the X-ray fluorescence spectrometer. In the external additive desorbing, the toner particles are processed using a classifier. Thus, some of the external additive is desorbed (separated) from the toner mother particles. The external additive desorbing is for example performed according to the method to be described in Examples.

$$R=100\times(IN_B-IN_A)/IN_B \quad (1)$$

The external additive element is an element that is contained in the external additive and that is a measurement target for the fluorescent X-ray analysis. In a configuration in which two or more elements are contained in the external additive, one of the elements is selected as the external additive element. Preferably, one element that is contained only in the external additive is selected as the external additive element from among elements within the toner particles (the toner mother particles and the external additive). In a configuration in which the external additive is silica particles, Si (silicon) is used as an external additive element. In a situation in which the elements within the toner particles include two or more elements that are contained only in the external additive, one of the two or more elements is selected as an external additive element. The desorption is for example measured by a method to be described in Examples.

In a configuration of the toner according to the present embodiment in which the toner cores are anionic and a material of the shell layers (hereinafter, referred to as a shell material) is cationic, the cationic shell material can be attracted toward the surface of the toner cores in formation of the shell layers. In a more specific example, in an aqueous medium in which the shell material is positively charged and the toner cores are negatively charged, it is thought that the shell material is electrically attracted toward the toner cores and shell layers are formed on the surface of the toner cores through in-situ polymerization. As a result of the shell material being attracted toward the toner cores, it is thought that the shell layers can be easily formed on the surface of the toner cores in a uniform manner without using a dispersant.

Hereinafter, the toner cores, the shell layers, and the external additive will be described in order. Non-essential components (for example, a colorant, a releasing agent, a charge control agent, and a magnetic powder) of the toner may be omitted in accordance with the intended use of the toner.

[Toner Cores]

The toner cores of the toner particles contain a binder resin. The toner cores of the toner particles may further contain an internal additive (for example, a colorant, a releasing agent, a charge control agent, and a magnetic powder).

(Binder Resin in Toner Cores)

Generally, the binder resin composes the majority (for example, no less than 85% by mass) of the components of the toner cores. Therefore, properties of the binder resin are thought to have a large influence on overall properties of the toner cores. For example, in a situation in which the binder resin has an ester group, a hydroxyl group, an ether group, an acid group, or a methyl group, the toner cores have a stronger tendency to be anionic. On the other hand, in a situation in which the binder resin has an amino group, amine, or an amide group, the toner cores have a stronger tendency to be cationic. In order that the binder resin is strongly anionic, the binder resin preferably has a hydroxyl value (OHV) and an acid value (AV) that are each no less than 10 mg KOH/g, and more preferably no less than 20 mg KOH/g.

The binder resin is preferably a resin having one or more functional groups selected from the group consisting of an ester group, a hydroxyl group, an ether, an acid group, and a methyl group, and more preferably a resin having either or both of a hydroxyl group and an acid group (for example, a carboxyl group). A binder resin having a functional group such as described above readily reacts with the shell material (for example, methylol melamine) to form chemical bonds. Formation of chemical bonds between the binder resin and the shell material ensures strong bonding between the toner cores and the shell layers. Also, the binder resin preferably has a functional group including activated hydrogen in molecules thereof.

The binder resin preferably has a glass transition point (Tg) that is no greater than a curing initiation temperature of the shell material. As a result of the binder resin having a Tg such as described above, it is thought that the toner is resistant to reduction in fixability even during high speed fixing.

Tg of the binder resin can be for example measured using a differential scanning calorimeter. More specifically, Tg of the binder resin can be measured by plotting a heat absorption curve of a sample (binder resin) using a differential scanning calorimeter ("DSC-6220", product of Seiko Instruments Inc.) and calculating Tg from a point of change in specific heat on the heat absorption curve.

The binder resin preferably has a softening point (Tm) of no greater than 100° C., and more preferably no greater than 95° C. As a result of Tm of the binder resin being no greater than 100° C. (more preferably no greater than 95° C.), the toner is resistant to reduction in fixability even during high speed fixing. Also, as a result of Tm of the binder resin being no greater than 100° C. (more preferably no greater than 95° C.), the toner cores are readily partially softened while a curing reaction of the shell layers occurs during formation of the shell layers on the surface of the toner cores in an aqueous medium, thereby readily causing spheroidizing due to surface tension. Note that Tm of the binder resin can be adjusted by combining, as the binder resin, a plurality of resins that each have a different Tm.

Tm of the binder resin can be for example measured using a capillary rheometer. More specifically, a sample (the binder resin) is placed in a capillary rheometer ("CFT-500D", product of Shimadzu Corporation), and melt-flow of the binder resin is caused under specified conditions. Thus, an S-shaped curve for the binder resin is plotted. Tm of the binder resin can be read from the S-shaped curve that is obtained. Tm of the measurement sample (binder resin) is a temperature on the S-shaped curve corresponding to a stroke value of $(S_1+S_2)/2$, where $S_1$ represents a maximum stroke value and $S_2$ represents a base line stroke value at low temperatures.

The binder resin is preferably a thermoplastic resin. Examples of preferable thermoplastic resins that can be used as the binder resin include styrene-based resins, acrylic acid-based resins, olefin resins (more specifically, polyethylene resins and polypropylene resins), vinyl resins (more specifically, vinyl chloride resins, polyvinyl alcohol resins, vinyl ether resins, and N-vinyl resins), polyester resins, polyamide resins, urethane resins, styrene-acrylic acid-based resins, and styrene-butadiene-based resins. Of the resins listed above, styrene-acrylic acid-based resins and polyester resins are preferable in terms of improvement in dispersibility of the colorant in the toner, chargeability of the toner, and fixability of the toner with respect to a recording medium.

Hereinafter, a styrene-acrylic acid-based resin that can be used as the binder resin will be described. The styrene-acrylic acid-based resin is a copolymer of a styrene-based monomer and an acrylic acid-based monomer.

Examples of preferable styrene-based monomers include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Examples of preferable acrylic acid-based monomers include (meth)acrylic acid, alkyl (meth)acrylates, and hydroxyalkyl (meth)acrylates. Examples of the alkyl (meth) acrylates include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Examples of the hydroxyalkyl (meth)acrylates include 2-hydroxyethyl(meth)acrylate, 3-hydroxypropyl(meth)acrylate, 2-hydroxypropyl(meth) acrylate, and 4-hydroxybutyl(meth)acrylate. Note that the term "(meth)acryl" is used as a generic term for both acryl and methacryl.

A hydroxyl group can be introduced into the styrene-acrylic acid-based resin by using a monomer having a hydroxyl group (for example, p-hydroxystyrene, m-hydroxystyrene, or a hydroxyalkyl (meth)acrylate) in preparation of the styrene-acrylic acid-based resin. The hydroxyl value of the styrene-acrylic acid-based resin which is prepared can be adjusted through adjustment of the amount of the hydroxyl group-containing monomer used during preparation of the styrene-acrylic acid-based resin.

A carboxyl group can be introduced into the styrene-acrylic acid-based resin by using (meth)acrylic acid (monomer) used during preparation of the styrene-acrylic acid-based resin. The acid value of the styrene-acrylic acid-based resin which is prepared can be adjusted through adjustment of the amount of the (meth)acrylic acid used during preparation of the styrene-acrylic acid-based resin.

In a situation in which the binder resin is a styrene-acrylic acid-based resin, a number average molecular weight (Mn) of the styrene-acrylic acid-based resin is preferably at no less than 2,000 and no greater than 3,000 in order to improve strength of the toner cores and fixability of the toner. Preferably, the styrene-acrylic acid-based resin has a molecular weight distribution (i.e., a ratio Mw/Mn of mass average molecular weight (Mw) relative to number average molecular weight (Mn)) of no less than 10 and no greater than 20. Mn and Mw of the styrene-acrylic acid-based resin can be measured by gel permeation chromatography.

Hereinafter, a polyester resin that can be used as the binder resin will be described. The polyester resin is prepared through polymerization of a di-, tri-, or higher-hydric alcohol and a di-, tri-, or higher-basic carboxylic acid.

Examples of di-hydric alcohols that can be used in preparation of the polyester resin include diols and bisphenols.

Examples of preferable diols include ethylene glycol, diethylene glycol, triethylene glycol, propylene glycol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols that can be used in preparation of the polyester resin include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable di-basic carboxylic acids that can be used in preparation of the polyester resin include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (more specifically, n-butylsuccinic acid, isobutylsuccinic acid, n-octylsuccinic acid, n-dodecylsuccinic acid, and isododecylsuccinic acid), and alkenyl succinic acids (more specifically, n-butenylsuccinic acid, isobutenylsuccinic acid, n-octenylsuccinic acid, n-dodecenylsuccinic acid, and isododecenylsuccinic acid).

Examples of preferable tri- or higher-basic carboxylic acids that can be used in preparation of the polyester resin include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Alternatively, an ester-forming derivative (for example, acid halide, acid anhydride, or lower alkyl ester) of any of the di-, tri-, or higher-basic carboxylic acids listed above may be used. Herein, the term "lower alkyl" refers to an alkyl group having 1 to 6 carbon atoms.

The acid value and the hydroxyl value of the polyester resin can be adjusted through adjustment of the amount of the alcohol and the amount of the carboxylic acid used during preparation of the polyester resin. Increasing the molecular weight of the polyester resin tends to decrease the acid value and the hydroxyl value of the polyester resin.

In a situation in which the binder resin is a polyester resin, a number average molecular weight (Mn) of the polyester resin is preferably at no less than 1,000 and no greater than 2,000 in order to improve strength of the toner cores and fixability of the toner. The polyester resin preferably has a molecular weight distribution (i.e., a ratio Mw/Mn of mass average molecular weight (Mw) relative to number average molecular weight (Mn)) of no less than 9 and no greater than 21. Mn and Mw of the polyester resin can be measured by gel permeation chromatography.

(Colorant for Toner Cores)

The toner cores of the toner particles may contain a colorant. The colorant can be a commonly known pigment or dye that matches the color of the toner. The amount of the colorant is preferably no less than 1 part by mass and no greater than 20 parts by mass relative to 100 parts by mass of the binder resin, and more preferably no less than 3 parts by mass and no greater than 10 parts by mass.

The toner cores of the toner particles may contain a black colorant. The black colorant is for example carbon black. Alternatively, the black colorant may be a colorant that has been adjusted to a black color using colorants such as a yellow colorant, a magenta colorant, and a cyan colorant.

The toner cores of the toner particles may optionally contain a non-black colorant such as a yellow colorant, a magenta colorant, or a cyan colorant.

Examples of yellow colorants include condensed azo compounds, isoindolinone compounds, anthraquinone compounds, azo metal complexes, methine compounds, and arylamide compounds. Examples of preferable yellow colorants include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

Examples of magenta colorants include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of preferable magenta colorants include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Examples of cyan colorants include copper phthalocyanine compounds, copper phthalocyanine derivatives, anthraquinone compounds, and basic dye lake compounds. Examples of preferable cyan colorants include C.I. Pigment Blue (1, 7, 15, 15:1, 15:2, 15:3, 15:4, 60, 62, and 66), Phthalocyanine Blue, C.I. Vat Blue, and C.I. Acid Blue.

(Releasing Agent for Toner Cores)

The toner cores of the toner particles may contain a releasing agent. The releasing agent is for example used in order to improve fixability or offset resistance of the toner. The toner cores are preferably prepared using an anionic wax in order to increase the anionic strength of the toner cores. The amount of the releasing agent is preferably no less than 1 part by mass and no greater than 30 parts by mass relative to 100 parts by mass of the binder resin, and more preferably no less than 5 parts by mass and no greater than 20 parts by mass in order to improve fixability or offset resistance of the toner.

Examples of preferable releasing agents include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as major component such as montanic acid ester wax and castor wax; and waxes in which a part or all of a fatty acid ester has been deoxidized such as deoxidized carnauba wax.

A compatibilizer may be added to the toner cores of the toner particles in order to improve compatibility between the binder resin and the releasing agent.

(Charge Control Agent for Toner Cores)

The toner cores of the toner particles may contain a charge control agent. The charge control agent is for example used in order to improve charge stability or a charge rise characteristic of the toner. The anionic strength of the toner cores can be increased through the toner cores containing a negatively chargeable charge control agent. The charge rise characteristic of the toner is an indicator as to whether the toner can be charged to a specific charge level in a short period of time.

(Magnetic Powder for Toner Cores)

The toner cores of the toner particles may contain a magnetic powder. Examples of the magnetic powder include iron (more specifically, ferrite and magnetite), ferromagnetic metals (more specifically, cobalt and nickel), compounds (more specifically, alloys) containing either or both of iron and a ferromagnetic metal, ferromagnetic alloys subjected to ferromagnetization (more specifically, heat treatment), and chromium dioxide.

The magnetic powder is preferably subjected to surface treatment in order to inhibit elution of metal ions (for example, iron ions) from the magnetic powder. In a situation in which the shell layers are formed on the surface of the toner cores under acidic conditions, elution of metal ions to the surface of the toner cores causes the toner cores to adhere to one another more readily. Inhibiting elution of metal ions from the magnetic powder thereby inhibits the toner cores from adhering to one another.

[Shell Layers]

The shell layers contain a thermosetting resin and a thermoplastic resin. The shell layers are therefore readily formed over the surface of the toner cores in a uniform manner.

Preferably, the thermosetting resin is a polymer or a copolymer of at least one hydrophilic monomer. Preferably, the thermosetting resin is prepared through polymerization or copolymerization of a hydrophilic monomer. The thermosetting resin prepared through polymerization or copolymerization may be hydrophobic or hydrophilic so long as a monomer thereof is hydrophilic. Preferably, the thermoplastic resin is hydrophobic. As a result of the monomer of the thermosetting resin being hydrophilic and the thermoplastic resin being hydrophobic, compatibility between the thermosetting resin and the thermoplastic resin during the formation of the shell layers in an aqueous medium is improved. Furthermore, as a result of the thermosetting resin in the shell layers being a polymer or a copolymer of a hydrophilic monomer and the thermoplastic resin in the shell layers being hydrophobic, the charge of the toner is readily adjustable into a desired range. Note that the shell layers may for example contain a charge control agent (for example, a positively chargeable charge control agent).

When a substance is described as hydrophilic in the present specification, it means that the substance has an affinity for water to the extent that the substance is soluble in water. Being hydrophilic herein is equivalent to being water-soluble. When a substance is described as hydrophobic in the present specification, it means that the substance has an affinity for water to the extent that the substance is not soluble in water but is independently dispersible in water or an affinity for water to the extent that the substance is not soluble in water and not independently dispersible in water. Being hydrophobic herein is equivalent to being water-insoluble. In order to favorably promote the later-described shall layer formation, the hydrophobicity of the thermoplastic resin is preferably an affinity for water to the extent that the thermoplastic resin is not soluble in water but is independently dispersible in water.

The thermoplastic resin preferably has a functional group (for example, a hydroxyl group, a carboxyl group, an amino group, a carbodiimide group, an oxazoline group, or a glycidyl group) that readily reacts with a functional group of the thermosetting resin (for example, a methylol group or an amino group). The amino group may be present in the thermoplastic resin in the form of a carbamoyl group (—$CONH_2$).

In order to improve film quality of the shell layers, the thermoplastic resin preferably contains an acrylic acid-based monomer, more preferably contains a reactive acrylate, and particularly preferably contains HEMA (2-hydroxyethyl methacrylate).

Specific examples of the thermoplastic resin include acrylic acid-based resins, styrene-acrylic acid-based copolymers, silicone-acrylic acid-based graft copolymers, urethane resins, polyester resins, and ethylene vinyl alcohol copolymers. The thermoplastic resin is preferably an acrylic acid-based resin, a styrene-acrylic acid-based copolymer, or a silicone-acrylic acid-based graft copolymer, with an acrylic acid-based resin being more preferable.

Examples of acrylic acid-based monomers that can be used for introducing the thermoplastic resin into the shell layers include: alkyl (meth)acrylates such as methyl (meth) acrylate, ethyl (meth)acrylate, n-propyl (meth)acrylate, and butyl (meth)acrylate (more specifically, n-butyl (meth)acrylate); aryl (meth)acrylates such as phenyl (meth)acrylate; hydroxyalkyl (meth)acrylates such as 2-hydroxyethyl (meth)acrylate, 3-hydroxypropyl (meth)acrylate, 2-hydroxypropyl (meth)acrylate, and 4-hydroxybutyl (meth) acrylate; (meth)acrylamide; ethylene oxide adduct of (meth) acrylic acid; and alkyl ethers, such as methyl ether, ethyl ether, n-propyl ether, and n-butyl ether, of ethylene oxide adducts of (meth)acrylic acid esters.

Examples of preferable thermosetting resins include melamine resins, urea resins, sulfonamide resins, glyoxal resins, guanamine resins, aniline resins, and polyimide resins, and derivatives of the aforementioned resins. A polyimide resin contains nitrogen in a molecular framework thereof. As a consequence, shell layers containing a polyimide resin tend to be strongly cationic. Examples of polyimide resins include maleimide-based polymers and bismaleimide-based polymers (more specifically, amino-bismaleimide polymers and bismaleimide-triazine copolymers).

In particular, the thermosetting resin is preferably a resin generated by polycondensation of an aldehyde (for example, formaldehyde) and a compound containing an amino group. Note that a melamine resin is a polycondensate of melamine and formaldehyde. A urea resin is a polycondensate of urea and formaldehyde. A glyoxal resin is a polycondensate of formaldehyde and a reaction product of glyoxal and urea.

The melamine for forming the melamine resin, the urea for forming the urea resin, and the urea for reaction with glyoxal in forming of the glyoxal resin may each be modified in a known manner. For example, the monomer of the thermosetting resin may be converted to a methylolated derivative using formaldehyde prior to reaction with the thermoplastic resin.

The melamine for forming the melamine resin, the urea for forming the urea resin, and the reaction product of glyoxal and urea for forming the glyoxal resin may be used in the form of a prepolymer (hereinafter, may be referred to as an initial polymer). The term "prepolymer" used herein refers to an intermediate product obtained by stopping a polymerization reaction or a polycondensation reaction of a monomer at a stage before the degree of polymerization reaches the degree of polymerization for a polymer.

Inclusion of nitrogen in the thermosetting resin enables the thermosetting resin to perform a function of cross-link curing more effectively. In order that the thermosetting resin has a high reactivity, the amount of nitrogen contained therein is preferably adjusted to be no less than 40% by mass and no greater than 55% by mass in the case of a melamine resin. For the same purpose, the amount of nitrogen contained in the thermosetting resin is preferably adjusted to approximately 40% by mass in the case of a urea resin. For the same purpose, the amount of nitrogen contained in the thermosetting resin is preferably adjusted to approximately 15% by mass in the case of a glyoxal resin.

Examples of monomers (for example, a hydrophilic monomer) that can be used for introducing the thermosetting resin into the shell layers include melamine, methylol melamine, urea, methylol urea, a reaction product of glyoxal and urea, benzoguanamine, acetoguanamine, spiroguanamine, and dimethylol dihydroxyethyleneurea (DMDHEU).

The shell layers may have fractures therein (portions having low mechanical strength). The fractures can be formed by causing localized defects to occur in the shell layers. Formation of the fractures in the shell layers enables the shell layers to be ruptured more readily. Therefore, the toner can be fixed to a recording medium at low temperatures. Any appropriate number of fractures may be present in the shell layers.

[External Additive]

An external additive adheres to the surface of the toner mother particles. Examples of the external additive include particles of silica and metal oxides (for example, alumina, titanium oxide, magnesium oxide, zinc oxide, strontium titanate, and barium titanate).

The external additive preferably has a particle size of no less than 0.01 μm and no greater than 1.0 μm. The amount of the external additive is preferably no less than 0.5 parts by mass and no greater than 10 parts by mass relative to 100 parts by mass of the toner mother particles, and more preferably no less than 1 part by mass and no greater than 5 parts by mass.

A two-component developer is prepared by mixing the toner of the present embodiment and a desired carrier. The carrier used to prepare the two-component developer is preferably a magnetic carrier.

Examples of preferable carriers include a carrier in which carrier cores are coated by a resin. Specific examples of the carrier cores include: particles of iron, oxidized iron, reduced iron, magnetite, copper, silicon steel, ferrite, nickel, or cobalt; particles of an alloy of any of the above materials with a metal such as manganese, zinc, or aluminum; particles of iron-nickel alloy or iron-cobalt alloy; particles of ceramics (titanium oxide, aluminum oxide, copper oxide, magnesium oxide, lead oxide, zirconium oxide, silicon carbide, magnesium titanate, barium titanate, lithium titanate, lead titanate, lead zirconate, or lithium niobate); and particles of high-dielectric substances (ammonium dihydrogen phosphate, potassium dihydrogen phosphate, or Rochelle salt). The carrier may for example alternatively be a resin carrier prepared by dispersing any of the particles listed above in a resin.

Examples of the resin coating the carrier cores include acrylic acid-based polymers, styrene-based polymers, styrene-acrylic acid-based copolymers, olefin-based polymers (polyethylene, chlorinated polyethylene, or polypropylene), polyvinyl chloride, polyvinyl acetate, polycarbonate resins, cellulose resins, polyester resins, unsaturated polyester resins, polyamide resins, urethane resins, epoxy resins, silicone resins, fluororesins (polytetrafluoroethylene, polychlorotrifluoroethylene, or polyvinylidene fluoride), phenolic resins, xylene resins, diallyl phthalate resins, polyacetal resins, and amino resins. Two or more kinds of the resins listed above may be used in a combination.

The carrier preferably has a particle size measured using an electron microscope of no less than 20 μm and no greater than 120 μm, and more preferably no less than 25 μm and no greater than 80 μm.

In a situation in which the toner and a carrier are used to prepare a two-component developer, the amount of the toner is preferably no less than 3 parts by mass and no greater than 20 parts by mass relative to the mass of the two-component developer, and more preferably no less than 5 parts by mass and no greater than 15 parts by mass.

[Toner Manufacturing Method]

Next, a toner manufacturing method according to the present embodiment will be described. First, in the toner manufacturing method according to the present embodiment, toner cores are prepared. Next, at least a material for forming a thermoplastic resin, a material for forming a thermosetting resin, and the toner cores are added to a liquid. Then, shell layers containing the thermoplastic resin and the thermosetting resin are formed over the surface of the toner cores in the liquid.

More specifically, the liquid is prepared. The liquid may be for example an aqueous medium. The aqueous medium is a medium mainly containing water. The aqueous medium may function as a solution medium or a dispersion medium. Specific examples of the aqueous medium include water (for example, ion exchanged water) and a mixture of water and a polar solvent. Examples of the polar solvent included in the aqueous medium include methanol and ethanol. The amount of water contained in the aqueous medium is preferably no less than 70% by mass relative to the mass of the aqueous medium, more preferably no less than 80% by mass, still more preferably no less than 90% by mass, and most preferably 100% by mass.

Next, the toner cores are added to the liquid and dispersed therein. A shell material (i.e., the material for forming the thermoplastic resin and the material for forming the thermosetting resin) is subsequently added to the liquid containing the toner cores. The shell material is then dissolved or dispersed in the liquid. The pH of the liquid may be adjusted to approximately pH 4 using an acidic substance (for example, hydrochloric acid) in order to accelerate polycondensation reaction of the shell material. An appropriate amount of the shell material that is added can be calculated based on the specific surface area of the toner cores.

Next, the liquid is heated under stirring up to a polymerization temperature at which the polymerization reaction takes place. For example, the liquid is heated to the polymerization temperature at a rate of no less than 0.5° C./minute and no greater than 2° C./minute over 30 minutes. Preferably, the polymerization temperature is no less than 60° C. and no greater than 70° C. As a result of the polymerization temperature being within the above-specified range, the surface roughness and the surface adsorbability of the resulting toner mother particles are readily adjusted to desired values.

After the liquid is heated to the polymerization temperature, the liquid is maintained at the polymerization temperature under stirring. The time during which the liquid is maintained at the polymerization temperature (polymerization maintaining time) is preferably no less than 5 minutes and no greater than 20 minutes. As a result of the polymerization maintaining time being within the above-specified range, the surface roughness and the surface adsorbability of the resulting toner mother particles are readily adjusted to desired values. In a situation in which the polymerization temperature is no less than 60° C. and no greater than 65° C., the polymerization maintaining time is preferably greater than 15 minutes and no greater than 20 minutes. In a situation in which the polymerization temperature is no less than 65° C. and no greater than 70° C., the polymerization maintaining time is preferably no less than 10 minutes and no greater than 17 minutes. In a situation in which the polymerization temperature is 70° C., the polymerization maintaining time is preferably no less than 5 minutes and less than 10 minutes.

As a result of the liquid maintained at the polymerization temperature for the polymerization maintaining time, the shell material adheres to the surface of the toner cores and the adhered material polymerizes and cures. Through the above, the shell layers are formed over the surface of the toner cores. As a result, a dispersion of toner mother particles is obtained.

In a situation in which the temperature of the liquid reaches or exceeds a glass transition point (Tg) of the toner cores during the curing of the shell layers, the toner cores are likely to transform in terms of shape. For example, in a situation in which Tg of the binder resin of the toner cores is 45° C. and the thermosetting resin contained in the shell layers is a melamine resin, heating of the liquid to approximately 50° C. tends to cause a curing reaction of the shell material (specifically, the material for forming the thermosetting resin) to proceed rapidly and the toner cores to transform in terms of shape. When the shell material is caused to react at high temperatures, the shell layers tend to be hard. The toner cores transform more readily in terms of shape with increasing temperature of the liquid during the curing of the shell layers thereby tending to yield toner mother particles that are more spherical. Therefore, the temperature of the liquid during the curing of the shell layers is preferably adjusted in order to obtain toner mother particles of a desired shape. Adjusting the temperature of the liquid during the curing of the shell layers also enables control of the molecular weight of the shell layers.

After the shell layers are caused to cure as described above, the liquid is cooled. Subsequently, the dispersion of the toner mother particles is neutralized using, for example, sodium hydroxide. Next, the liquid is filtered. Through the above process, the toner mother particles are separated from the liquid (solid-liquid separation). Next, the toner mother particles that have been separated are washed. Next, the toner mother particles that have been washed are dried. An external additive is subsequently caused to adhere to the surface of the toner mother particles. The above completes the manufacture of a toner including a large number of toner particles.

The toner manufacturing method can be altered in accordance with desired properties of the toner. Non-essential operations and processes may alternatively be omitted. The order of the processes may be changed. For example, the toner cores may be added to the liquid after the shell material has been added. Preferably, a large number of the toner particles are formed at the same time in order that the toner can be manufactured efficiently.

The toner of the present embodiment has been described so far. According to the toner of the present embodiment, it is possible to restrict occurrence of fogging in an image that is formed while maintaining good charge.

EXAMPLES

Examples of the present disclosure will be described. Hereinafter, manufacturing methods, evaluation methods, and evaluation results of toners of Examples 1 to 8 and Comparative Examples 1 to 8 will be described in order. Note that unless otherwise stated, the evaluation results (for example, values indicating shape and physical properties) of a powder (for example, toner cores and toners) are averages of values measured with respect to an appropriate number of particles.

(Preparation of Suspension of Thermoplastic Resin A)

First, 875 mL of ion exchanged water and 75 mL of an anionic surfactant (sodium polyoxyethylene alkyl ether sulfate, "LATEMUL (registered Japanese trademark) WX", product of Kao Corporation, solid concentration: 26% by mass) were added to a 1 L three-necked flask having a thermometer and a stirring impeller. The internal temperature of the flask was maintained at 80° C. using a water bath. Next, a mixture of 14 mL of styrene, 4 mL of 2-hydroxyethyl methacrylate (HEMA), and 2 mL of butyl acrylate was dripped into the flask over 5 hours. At the same time, a solution obtained through dissolution of 0.5 g of potassium peroxodisulfate in 30 mL of ion exchanged water was dripped into the flask over 5 hours. The flask was then maintained at 80° C. for 2 hours to cause polymerization, giving a suspension of a thermoplastic resin A (solid concentration: 10% by mass). The resulting thermoplastic resin A had a number average particle size of 38 nm. The number average particle size was measured using a transmission electron microscope.

(Preparation of Suspension of Thermoplastic Resin B)

A suspension of a thermoplastic resin B (solid concentration: 10% by mass) was prepared in the same manner as for the suspension of the thermoplastic resin A except that the dripping time of the mixture of 14 mL of styrene, 4 mL of 2-hydroxyethyl methacrylate (HEMA), and 2 mL of butyl acrylate, and the solution obtained through dissolution of 0.5 g of potassium peroxodisulfate in 30 mL of ion exchanged water was changed from 5 hours to 7 hours. The resulting thermoplastic resin B had a number average particle size of 42 nm.

Example 1

(Preparation of Toner Cores)

Using an FM mixer ("FM-10B", product of Nippon Coke & Engineering Co.), 750 g of a low viscosity polyester resin (Tg: 38° C., Tm: 65° C.), 100 g of a medium viscosity polyester resin (Tg: 53° C., Tm: 84° C.), 150 g of a high viscosity polyester resin (Tg: 71° C., Tm: 120° C.), 55 g of carnauba wax ("Carnauba Wax No. 1", product of S. Kato & Co.), and 40 g of a colorant (Phthalocyanine Blue, "KET BLUE 111", product of DIC Corporation) were mixed at a rotation speed of 2,400 rpm. The melt viscosity of the binder resin (polyester resin) can be decreased by increasing a ratio of the low viscosity polyester resin therein.

Next, the resulting mixture was melt-kneaded using a twin screw extruder ("PCM-30", product of Ikegai Corp.) under conditions of a material addition rate of 5 kg/hour, a shaft rotation speed of 160 rpm, and a temperature range from no less than 80° C. to no greater than 110° C. A kneaded product obtained through the above was subsequently cooled.

Next, the kneaded product was roughly pulverized using a mechanical pulverizer ("Rotoplex (registered Japanese trademark)", product of Hosokawa Micron Corporation). The roughly pulverized product was finely pulverized using a jet mill ("Model-I Super Sonic Jet Mill", product of Nippon Pneumatic Mfg.). Next, the finely pulverized product was classified using a classifier ("Elbow Jet EJ-LABO", product of Nittetsu Mining Co., Ltd.).

(Formation of shell layers)

A 1 L three-necked flask having a thermometer and a stirring impeller was set up in a water bath. The internal temperature of the flask was maintained at 30° C. using a water bath. Next, 500 mL of ion exchanged water and 50 g of sodium polyacrylate ("JURYMER (registered Japanese trademark) AC-103", product of Toagosei Co., Ltd.) were added to the flask. As a result, an aqueous solution of sodium polyacrylate was obtained in the flask.

Next, 100 g of the toner cores prepared as described above were added to the aqueous solution of sodium polyacrylate. Next, the contents of the flask were sufficiently stirred at room temperature. Through the above, a dispersion of the toner cores was obtained in the flask.

The dispersion of the toner cores was filtered using filter paper having a pore size of 3 μm. The toner cores separated through the filtration was re-dispersed in ion exchanged water. Filtration and re-dispersion was repeated five times in order to wash the cores. Next, a suspension of 100 g of the toner cores in 500 mL of ion exchanged water was prepared in a flask.

Next, 1 g of an aqueous solution of methylol urea ("MIRBANE (registered Japanese trademark) SU-100", product of Showa Denko K.K., solid concentration: 80% by mass) as a material of a thermosetting resin and 6.5 g of the suspension of the thermoplastic resin A were added to the flask. Next, the suspension in the flask was adjusted to pH 4 through addition of dilute hydrochloric acid to the flask.

After pH adjustment, the suspension was transferred to a 1 L separable flask. Next, the inner temperature of the flask was raised to 65° C. at a heating rate of 0.5° C./minute while the contents (a mixture of the toner cores and the shell material) of the flask were stirred at a rotational speed of 100 rpm. The inner temperature of the flask was then maintained at 65° C. (polymerization temperature) for 15 minutes (polymerization maintaining time) while the contents (the mixture of the toner cores and the shell material) of the flask were stirred at a rotational speed of 150 rpm. As a result of the inner temperature of the flask maintained at a high temperature (65° C.), the shell material underwent a polymerization reaction, and the toner cores and the shell material were reacted with one another, forming shell layers including the thermoplastic resin and the thermosetting resin over the surfaces of the toner cores. As a result, a dispersion of toner mother particles was obtained. Next, the dispersion of the toner mother particles was cooled to room temperature, and the dispersion of the toner mother particles was adjusted to pH 7 using sodium hydroxide.

(Washing and Drying of Toner Mother Particles)

The toner mother particles were isolated by filtration (solid-liquid separation) of the toner mother particles from the dispersion thereof. The toner mother particles were subsequently re-dispersed in ion exchanged water. Dispersion and filtration of the toner mother particles was repeated to wash the toner mother particles. Next, the toner mother particles were dried.

(External Addition)

External addition to the toner mother particles was performed after the drying described above. An external additive (silica particles) was caused to adhere to the surface of the toner mother particles by mixing 100 parts by mass of the toner mother particles and 1.5 parts by mass of dry silica particles ("REA90", product of Nippon Aerosil Co., Ltd.). Through the above, a toner of Example 1 containing a large number of toner particles was manufactured.

Example 2

A toner of Example 2 was prepared in the same manner as for the toner of Example 1 except that the polymerization maintaining time for shell layer formation was changed from 15 minutes to 10 minutes.

Example 3

A toner of Example 3 was prepared in the same manner as for the toner of Example 1 except that the polymerization maintaining time for shell layer formation was changed from 15 minutes to 17 minutes.

Example 4

A toner of Example 4 was prepared in the same manner as for the toner of Example 1 except that the polymerization temperature was changed from 65° C. to 70° C. and the polymerization maintaining time was changed from 15 minutes to 5 minutes in the shell layer formation.

Example 5

A toner of Example 5 was prepared in the same manner as for the toner of Example 1 except that the polymerization temperature was changed from 65° C. to 60° C. and the polymerization maintaining time was changed from 15 minutes to 20 minutes in the shell layer formation.

Example 6

A toner of Example 6 was prepared in the same manner as for the toner of Example 1 except that the suspension of the thermoplastic resin B was used instead of the suspension of the thermoplastic resin A in the shell layer formation.

Example 7

A toner of Example 7 was prepared in the same manner as for the toner of Example 1 except that 1 g of water-soluble methylol melamine ("Nikaresin (registered Japanese trademark) S-176", product of Nippon Carbide Industries Co., Inc.) was used as a material of the thermosetting resin instead of 1 g of methylol urea in the shell layer formation.

Example 8

A toner of Example 8 was prepared in the same manner as for the toner of Example 1 except that 1 g of water-soluble methylol melamine ("Nikaresin (registered Japanese trademark) S-260", product of Nippon Carbide Industries Co., Inc.) was used as a material of the thermosetting resin instead of 1 g of methylol urea in the shell layer formation.

Comparative Example 1

A toner of Comparative Example 1 was prepared in the same manner as for the toner of Example 1 except that the mixture of the toner cores and the shell material was cooled to room temperature immediately after the temperature of the mixture reached 65° C. (the polymerization maintaining time was changed to 0 minutes) in the shell layer formation.

Comparative Example 2

A toner of Comparative Example 2 was prepared in the same manner as for the toner of Example 1 except that the polymerization maintaining time was changed from 15 minutes to 20 minutes in the shell layer formation.

Comparative Example 3

A toner of Comparative Example 3 was prepared in the same manner as for the toner of Comparative Example 2 except that the polymerization temperature was changed from 65° C. to 70° C. and the polymerization maintaining time was changed from 20 minutes to 10 minutes in the shell layer formation.

Comparative Example 4

A toner of Comparative Example 4 was prepared in the same manner as for the toner of Comparative Example 2 except that the polymerization temperature was changed from 65° C. to 60° C. and the polymerization maintaining time was changed from 20 minutes to 15 minutes in the shell layer formation.

Comparative Example 5

A toner of Comparative Example 5 was prepared in the same manner as for the toner of Comparative Example 2 except that the polymerization temperature was changed from 65° C. to 60° C. and the polymerization maintaining time was changed from 20 minutes to 35 minutes in the shell layer formation.

Comparative Example 6

A toner of Comparative Example 6 was prepared in the same manner as for the toner of Comparative Example 2 except that the suspension of the thermoplastic resin B was used instead of the suspension of the thermoplastic resin A and the polymerization maintaining time was changed from 20 minutes to 30 minutes in the shell layer formation.

Comparative Example 7

A toner of Comparative Example 7 was prepared in the same manner as for the toner of Comparative Example 2 except that 1 g of water-soluble methylol melamine ("Nikaresin (registered Japanese trademark) S-176", product of Nippon Carbide Industries Co., Inc.) was used as a material of the thermosetting resin instead of 1 g of methylol urea and the polymerization maintaining time was changed from 20 minutes to 30 minutes in the shell layer formation.

Comparative Example 8

A toner of Comparative Example 8 was prepared in the same manner as for the toner of Comparative Example 2 except that 1 g of water-soluble methylol melamine ("Nikaresin (registered Japanese trademark) S-260", product of Nippon Carbide Industries Co., Inc.) was used instead of 1 g of methylol urea and the polymerization maintaining time was changed from 20 minutes to 30 minutes in the shell layer formation.

[Evaluation Methods]

Samples (the toners of Examples 1 to 8 and Comparative Examples 1 to 8) were evaluated according to the following methods.

<Surface Roughness>

Surface roughness of a sample (toner mother particles) was measured according to the following method. The measurement was performed using a scanning probe station ("NanoNaviReal", product of Hitachi High-Tech Science Corporation) equipped with a scanning probe microscope (SPM) ("multifunctional unit AFM5200S", product of Hitachi High-Tech Science Corporation). Furthermore, a cantilever ("SI-DF3-R", product of Hitachi High-Tech Science Corporation, tip diameter: 30 nm, probe coating material: rhodium, spring constant: 1.6 N/m, resonance frequency: 26 kHz) was used with the evaluation device. An image of 256×256 pixels was obtained by measuring a surface profile of a measurement target (toner mother particle) under conditions of an observation area of 1 μm×1 μm, a scanning frequency of 1 Hz, a magnification for plotting a Q-curve of ×1.001, and an amplitude extinction ratio of −0.4. Roughness analysis was performed on the image thus obtained to determine the surface roughness (ten-point average roughness) of the measurement target (toner mother particle). Values of the surface roughness (ten-point average roughness) of ten measurement targets were determined, and a number average value thereof was taken as an evaluation value (a surface roughness of the toner mother particles).

<Surface Adsorbability>

Surface adsorbability of a sample (toner mother particles) was measured according to the following method. The measurement was performed using the same evaluation device as for the surface roughness. A projection of a measurement target (toner mother particle) was placed at the center of a measurement area. The measurement range was set at a range of −10 nm to 100 nm and the magnification was set at ×1.00. Next, sweeping was performed around a peak of the projection determined in the measurement range for 5 seconds to plot a force curve. Ten toner mother particles were measured for the force curve, and each toner mother particle was measured for the adsorbability at five points. An arithmetic mean value of the adsorbability values thus obtained was taken as an evaluation value (a surface adsorbability of the toner mother particles).

<Desorption of Silica Particles>

External additive desorbing was performed on toner particles contained in a sample (toner) according to the following method. The external additive desorbing was performed using a classifier (high-accuracy air classifier, "Dispersion Separator", product of Nippon Pneumatic Mfg. Co., Ltd.). The external additive desorbing was performed under conditions specified below. Through the external additive desorbing, some of the silica particles were desorbed from the toner mother particles and the desorbed silica particles were removed.

(Conditions for External Additive Desorbing)

Injection pressure at feed section: 0.2 MPa/cm$^2$
Adjusting ring: 80 mm
Louver height: 10 mm
Louver clearance: 5 mm
Distance ring: 0 mm
Center navel: 60 mm
U damper: 45°
Cyclone damper: 30°
Total static pressure: −1400 mmAq Fluorescent X-ray intensity of Si (silicon) within the toner particles prior to the external additive desorbing (prior to the removal of the desorbed silica particles) was measured ten times using an X-ray fluorescence spectrometer ("ZSX", product of Rigaku Corporation). An arithmetic mean value of the fluorescent X-ray intensity values thus obtained was taken as an evaluation value (fluorescent X-ray intensity $IN_B$). Next, fluorescent X-ray intensity of Si (silicon) within the toner particles after the external additive desorbing (after the removal of the desorbed silica particles) was measured ten times. An arithmetic mean value of the fluorescent X-ray intensity values thus obtained was taken as an evaluation value (fluorescent X-ray intensity $IN_A$).

As a desorption, a percentage of the silica particles desorbed from the toner mother particles was calculated from the evaluation values (fluorescent X-ray intensity $IN_B$ and fluorescent X-ray intensity $IN_A$) in accordance with the expression (1).

$$R=100\times(IN_B-IN_A)/IN_B \quad (1)$$

<Charge>

A ball mill was used to mix 100 parts by mass of a developer carrier ("carrier for FS-C5300DN", product of KYOCERA Document Solutions Inc.) and 10 parts by mass of a sample (toner) for 30 minutes to prepare a two-component developer. The two-component developer was left to stand at a temperature of 20° C. and relative humidity (RH) of 65% for 24 hours. Next, charge of the toner in the two-component developer was measured in the same environment (temperature: 20° C., RH: 65%) using a Q/m meter ("MODEL 210HS", product of TREK, INC.). More specifically, the sample (toner) in 0.10 g (±0.01 g) of the developer was drawn in using a suction section of the Q/m meter and charge was calculated based on the amount of drawn-in sample (toner) and the displayed result (amount of charge) of the Q/m meter. The charge of the sample (toner) was evaluated according to the following criteria.

Good (G): A charge of the sample (toner) of no less than 25 μC/g and no greater than 35 μC/g Poor (P): A charge of the sample (toner) of less than 25 μC/g or greater than 35 μC/g <Image Density and Fogging Density>

A sample (toner) was left to stand in a standard temperature and standard humidity environment (temperature: 23° C., RH: 50%) for 24 hours, and then used to print a sample image including a solid image on a recording medium (printing paper) with an evaluation device (a color printer "FS-C5300DN", product of KYOCERA Document Solutions Inc.). Image density (ID) of the solid image formed on the recording medium and fogging density (FD) of the recording medium were measured.

Subsequently, a specific evaluation pattern having a coverage of 0.5% was printed on 500 recording medium sheets (printing paper sheets) using the evaluation device ("FS-C5300DN", product of KYOCERA Document Solutions Inc.). Thereafter, a sample image including a solid image was printed on a recording medium (printing paper) using the evaluation device, and image density (ID) of the solid image formed on the recording medium and fogging density (FD) of the recording medium were measured.

Image density (ID) and fogging density (FD) measurements were performed using a Macbeth reflection densitometer ("RD914", sold by SAKATA INX ENG. CO., LTD.). Note that fogging density (FD) is a value calculated by subtracting the image density (ID) of a recording medium that has not been subjected to printing from the image density (ID) of a non-image section (white paper section) of the recording medium after being subjected to printing.

Image density (ID) was evaluated according to the following criteria.

Good (G): An image density (ID) of no less than 1.2

Poor (P): An image density (ID) of less than 1.2

Fogging density (FD) was evaluated according to the following criteria. A lower fogging density after printing 500 sheets indicates that fogging is less likely to occur when image formation is performed repeatedly.

Good (G): A fogging density (FD) of less than 0.006

Poor (x): A fogging density (FD) of no less than 0.006

<Fogging Characteristic>

First, 100 g of the carrier ("carrier for FS-C5300DN", product of KYOCERA Document Solutions Inc.) and 6% by mass of a sample (toner) relative to the mass of the carrier were added into a 100 mL plastic container, and the carrier and the toner were stirred for 10 minutes using a powder mixer ("Rocking Mixer (registered Japanese trademark)", product of Aichi Electric Co., Ltd.). Next, the resulting mixture (developer) in the plastic container was caused to deteriorate.

Hereinafter, a method of causing deterioration of the developer will be described with reference to FIGURE. FIGURE is a diagram illustrating a deterioration device 100 for causing deterioration of the developer.

As illustrated in FIGURE, the deterioration device 100 includes a rotational driver 101 (for example, a motor), a rotational shaft 101*a*, a plate 102, and a dish 103. The rotational driver 101 causes rotation of the rotational shaft 101*a*. The plate 102 integrally rotates with the rotational shaft 101*a*. The plate 102 has projections 102*a* (blades). The dish 103 is an aluminum dish having a capacity of approximately 100 mL.

The dish 103 has a radius R of 28 mm. The dish 103 has a depth D1 of 25 mm. A distance D2 between the bottom surface of the dish 103 and the projections 102*a* of the plate 102 is 1 mm. A distance D3 between the bottom surface of the dish 103 and a top surface of the carrier is 5 mm. A distance L1 between the side surface of the dish 103 and the projections 102*a* of the plate 102 is 3 mm. The projections 102*a* of the plate 102 have a width L2 of 20 mm.

The mixture (developer S) in the plastic container was added into the dish 103. Next, the developer S was stirred for 10 minutes through rotation of the rotational shaft 101*a*, and thus also the plate 102, by the rotational driver 101. Through the above, the developer S became caught between the dish 103 and the projections 102*a*, thereby causing deterioration of the developer S. Deteriorated developer was obtained as a result of the process described above.

Next, 3 g of the deteriorated developer was added to a 20 mL bottle with 0.18 g of the original sample (non-deteriorated toner). The contents of the bottle were stirred for one minute using a powder mixer ("Rocking Mixer (registered Japanese trademark)", product of Aichi Electric Co., Ltd.). An evaluation developer was obtained through the above process.

Next, 2 g of the evaluation developer was mounted uniformly on an SUS304 sleeve (length: 230 mm, diameter: 20 mm) having an internal magnet, and an electrode (segmented electrode) was set up at a distance of 4.5 mm from the sleeve. Note that SUS304 refers to austenitic stainless steel (an alloy of iron (Fe), chromium (Cr), and nickel (Ni) having a nickel content of 8% and a chromium content of 18%). The sleeve was rotated while applying a voltage of 1.5 kV to the electrode for 30 seconds and an amount of scattering toner (oppositely charged toner) that adhered to the electrode was measured as a value representing a fogging characteristic. Based on the amount of scattering toner, the fogging characteristic was evaluated according to the following criteria. A smaller amount of scattering toner indicates that replenishment fogging is less likely to occur in a resulting image.

Good (G): An amount of scattering toner of less than 20 mg

Poor (P): An amount of scattering toner of no less than 20 mg

[Evaluation Results]

Evaluation results of the toners of Examples 1 to 8 and Comparative Examples 1 to 8 are as follows. Table 1 shows evaluation results of charge, image density, fogging density, and fogging characteristic for each of the toners.

TABLE 1

| | Conditions for shell layer formation | | Data of measurement with SPM | | | | |
|---|---|---|---|---|---|---|---|
| | Polymerization temperature (° C.) | Polymerization maintaining time (minutes) | Surface roughness (nm) | Surface adsorbability (nN) | Desorption of external additive (%) | Charge Value (μC/g) | Charge Evaluation |
| Example 1 | 65 | 15 | 12 | 15 | 7 | 28 | G |
| Example 2 | 65 | 10 | 15 | 20 | 5 | 26 | G |
| Example 3 | 65 | 17 | 10 | 10 | 10 | 34 | G |
| Example 4 | 70 | 5 | 10 | 20 | 5 | 27 | G |
| Example 5 | 60 | 20 | 13 | 15 | 8 | 29 | G |
| Example 6 | 65 | 15 | 13 | 15 | 7 | 29 | G |
| Example 7 | 65 | 15 | 12 | 16 | 8 | 29 | G |
| Example 8 | 65 | 15 | 12 | 17 | 6 | 30 | G |
| Comparative Example 1 | 65 | 0 | 16 | 21 | 4 | 24 | P |
| Comparative Example 2 | 65 | 20 | 9 | 20 | 11 | 32 | G |
| Comparative Example 3 | 70 | 10 | 7 | 9 | 12 | 30 | G |
| Comparative Example 4 | 60 | 15 | 17 | 21 | 3 | 23 | P |
| Comparative Example 5 | 60 | 35 | 8 | 20 | 4 | 24 | P |
| Comparative Example 6 | 65 | 30 | 8 | 8 | 13 | 31 | G |
| Comparative Example 7 | 65 | 30 | 7 | 8 | 11 | 29 | G |
| Comparative Example 8 | 65 | 30 | 7 | 9 | 12 | 30 | G |

| | Image density | | | | Fogging density | | | | Fogging characteristic | |
|---|---|---|---|---|---|---|---|---|---|---|
| | Initial | | After printing 500 sheets | | Initial | | After printing 500 sheets | | | |
| | ID | Evaluation | ID | Evaluation | FD | Evaluation | FD | Evaluation | Amount (mg) | Evaluation |
| Example 1 | 1.27 | G | 1.23 | G | 0.002 | G | 0.002 | G | 15 | G |
| Example 2 | 1.26 | G | 1.25 | G | 0.003 | G | 0.002 | G | 10 | G |
| Example 3 | 1.35 | G | 1.31 | G | 0.001 | G | 0.001 | G | 19 | G |
| Example 4 | 1.25 | G | 1.25 | G | 0.002 | G | 0.002 | G | 10 | G |
| Example 5 | 1.29 | G | 1.24 | G | 0.002 | G | 0.001 | G | 17 | G |
| Example 6 | 1.28 | G | 1.23 | G | 0.001 | G | 0.001 | G | 15 | G |
| Example 7 | 1.27 | G | 1.24 | G | 0.001 | G | 0.001 | G | 14 | G |
| Example 8 | 1.30 | G | 1.27 | G | 0.001 | G | 0.001 | G | 17 | G |
| Comparative Example 1 | 1.33 | G | 1.35 | G | 0.005 | G | 0.006 | P | 10 | G |
| Comparative Example 2 | 1.35 | G | 1.28 | G | 0.004 | G | 0.005 | G | 22 | P |
| Comparative Example 3 | 1.37 | G | 1.29 | G | 0.003 | G | 0.004 | G | 24 | P |
| Comparative Example 4 | 1.35 | G | 1.34 | G | 0.005 | G | 0.007 | P | 9 | G |
| Comparative Example 5 | 1.32 | G | 1.36 | G | 0.001 | G | 0.006 | P | 9 | G |
| Comparative Example 6 | 1.38 | G | 1.31 | G | 0.004 | G | 0.005 | G | 23 | P |
| Comparative Example 7 | 1.35 | G | 1.30 | G | 0.002 | G | 0.003 | G | 24 | P |
| Comparative Example 8 | 1.37 | G | 1.29 | G | 0.004 | G | 0.005 | G | 22 | P |

The toners of Examples 1 to 8 were excellent in charge, initial image density, image density after printing 500 sheets, initial fogging density, fogging density after printing 500 sheets, and fogging characteristic.

What is claimed is:

1. An electrostatic latent image developing toner comprising a plurality of toner particles each including:

a toner mother particle; and an external additive, wherein the toner mother particle includes a toner core and a shell layer disposed over a surface of the toner core, the shell layer contains a thermosetting resin and a thermoplastic resin, the toner mother particles have a surface roughness of no less than 10 nm and no greater than 15 nm, and the toner mother particles have a surface adsorbability of no less than 10 nN and no greater than 20 nN.

2. The electrostatic latent image developing toner according to claim 1, wherein the toner particles have a desorption of the external additive of no less than 5% and no greater than 10%, the desorption of the external additive is represented by expression (1) shown below $$R=100\times(IN_B-IN_A)/IN_B \quad (1)$$

where, in the expression (1),

R represents the desorption of the external additive, $IN_B$ represents a fluorescent X-ray intensity of an external additive element obtained through measurement of the toner particles prior to external additive desorbing using an X-ray fluorescence spectrometer, and $IN_A$ represents a fluorescent X-ray intensity of the external additive element obtained through measurement of the toner particles after the external additive desorbing using the X-ray fluorescence spectrometer, the external additive desorbing is a process performed on the toner particles to desorb some of the external additive from the toner mother particles using a classifier, and the external additive element is an element that is contained in the external additive.

3. The electrostatic latent image developing toner according to claim 1, wherein the external additive is silica particles.

4. The electrostatic latent image developing toner according to claim 1, wherein the thermosetting resin is a polymer or a copolymer of at least one hydrophilic monomer, and the thermoplastic resin is hydrophobic.

* * * * *